US012404082B2

(12) United States Patent
Erdie et al.

(10) Patent No.: US 12,404,082 B2
(45) Date of Patent: Sep. 2, 2025

(54) TUBE END CLOSURE

(71) Applicant: Erdie End Caps, LLC, Lorain, OH (US)

(72) Inventors: Jason S. Erdie, Richfield, OH (US); Randolph E. Digges, III, Bonita Springs, FL (US)

(73) Assignee: Erdie End Caps, LLC, Lorain, OH (US)

( * ) Notice: Subject to any disclaimer, the term of this patent is extended or adjusted under 35 U.S.C. 154(b) by 0 days.

(21) Appl. No.: 17/642,343

(22) PCT Filed: Sep. 16, 2020

(86) PCT No.: PCT/US2020/051042
§ 371 (c)(1),
(2) Date: Mar. 11, 2022

(87) PCT Pub. No.: WO2021/055453
PCT Pub. Date: Mar. 25, 2021

(65) Prior Publication Data

US 2022/0297909 A1 Sep. 22, 2022

Related U.S. Application Data

(60) Provisional application No. 63/020,201, filed on May 5, 2020, provisional application No. 62/964,872, filed
(Continued)

(51) Int. Cl.
*B65D 61/00* (2006.01)
*B65D 59/06* (2006.01)

(52) U.S. Cl.
CPC ..... *B65D 61/00* (2013.01); *B65D 59/06* (2013.01)

(58) Field of Classification Search
CPC ..... B65D 61/00; B65D 59/08; B65D 59/06; B65D 59/02; B65D 5/029; B65D 59/04;
(Continued)

(56) References Cited

U.S. PATENT DOCUMENTS 1,802,857 A 4/1931 Willauer
2,670,129 A 2/1954 Baxter et al.
(Continued)

FOREIGN PATENT DOCUMENTS

GB 399927 A 10/1933
WO 82/03062 A1 9/1982

OTHER PUBLICATIONS

International Search Report dated Feb. 1, 2021 filed in PCT/US2020/051042.

*Primary Examiner* — Christopher R Demeree
(74) *Attorney, Agent, or Firm* — Rankin, Hill & Clark LLP

(57) ABSTRACT

According to one aspect, a non-roll end sleeve is configured to be disposed on a seamless cylindrical paper tube, said non-roll sleeve having a rectangular cross-section perpendicular to a central axis of the cylindrical paper tube when disposed on the cylindrical paper tube. According to another aspect, a container includes a seamless paper tube having at least one end provided with a shape in cross-section generally having N sides, where N is an integer selected from 3 to 8, which at least one end is closed by flaps of material between openings cut into the at least one end that have been folded inwardly and secured in place to form an end closure.

17 Claims, 15 Drawing Sheets

Related U.S. Application Data on Jan. 23, 2020, provisional application No. 62/901,417, filed on Sep. 17, 2019.

(58) Field of Classification Search

CPC ..... B65D 5/0254; B65D 5/0281; B65D 5/04; B65D 5/14; B65D 85/671

USPC ..... 229/107, 5.5, 125.17, 93, 103.2, 125.09, 229/4.5; 138/115; 206/216, 416; 220/787, 789, 792

See application file for complete search history.

(56) References Cited

U.S. PATENT DOCUMENTS

| | | | | |
|---|---|---|---|---|
| 2,723,026 | A | 11/1955 | Paige | |
| 2,954,054 | A | 9/1960 | Shelly | |
| 3,081,017 | A | 3/1963 | Gerbino | |
| 3,974,914 | A * | 8/1976 | Cross | B65D 85/672 229/93 |
| 4,850,528 | A | 7/1989 | Hanus | |
| 7,296,730 | B2 | 11/2007 | Erdie | |
| 2005/0072838 | A1* | 4/2005 | Erdie | B65D 59/02 229/5.5 |
| 2005/0173504 | A1* | 8/2005 | Erdie | B65D 59/02 229/125.17 |
| 2007/0131738 | A1* | 6/2007 | Erdie | B65D 59/02 229/125.17 |
| 2007/0155608 | A1 | 7/2007 | Lehmann et al. | |
| 2008/0314912 | A1 | 12/2008 | Horsburgh et al. | |
| 2011/0168766 | A1* | 7/2011 | Erdie | B65D 19/0016 493/162 |

* cited by examiner

TUBE END CLOSURE

BACKGROUND

A cylindrical shape is conventionally employed in shipping containers for providing a desired structural integrity in the container, however, cylindrical containers often lack a practically stable upright orientation and also have a tendency to roll. As such, cylindrical tubes sometimes present difficulties when used as shipping containers due to their tendency to roll, especially when being transported on conveyor systems in sorting facilities. For example, rolling can cause the tubes to fall off the conveyor systems and/or cause the labels affixed to the tubes to not be properly positioned to be scanned by scanning devices associated therewith.

Furthermore, cylindrical tubes often require end closures for retaining contents therein. A variety of end closures are known in the art for closing an open end of a tube, and non-limiting examples of end closures include wooden or plastic plugs, which can be inserted into the open end of the tube and stapled in place for retaining contents in the paper tube. Plugs can be inserted into and removed from an open end of a paper tube by hand, but can sometimes inadvertently disengage from the open end of the paper tube, which then allows the contents of the container to spill out of the container. For example, plugs can be caused to disengage from a tube end when contents of a tube shift in the tube and strike an interior side of the plug, or when the tube is compressed and an internal pressure of the tube is increased.

BRIEF DESCRIPTION

According to one aspect, a non-roll end sleeve is configured to be disposed on a seamless cylindrical paper tube, said non-roll sleeve having a rectangular cross-section perpendicular to a central axis of the cylindrical paper tube when disposed on the cylindrical paper tube.

According to another aspect, a container includes a seamless paper tube having at least one end provided with a shape in cross-section generally having N sides, where N is an integer selected from 3 to 8, which at least one end is closed by flaps of material between openings cut into the at least one end that have been folded inwardly and secured in place to form an end closure.

According to another aspect, a method of making a container includes compressing at least one open end of a seamless paper tube having a circular cross-section to have a polygonal shape with N sides, where N is an integer selected from the group consisting of 3, 4, 5, 6, 7 and 8. The method also includes cutting a plurality of openings into the compressed open end of the seamless paper tube, and folding material between the plurality of openings inwardly to form flaps. The method also includes overlapping at least two of said flaps to close off the compressed open end of the seamless paper tube, and securing the flaps in place to form a first end closure.

According to another aspect, a container includes a seamless paper tube having at least one end provided with a shape in cross-section generally having N sides, where N is an integer selected from 3 to 8, which at least one end is closed by flaps of material between openings cut into the at least one end that have been folded inwardly and secured in place to form an end closure, and a non-roll extension protruding from said end closure.

DETAILED DESCRIPTION

Figure 1:
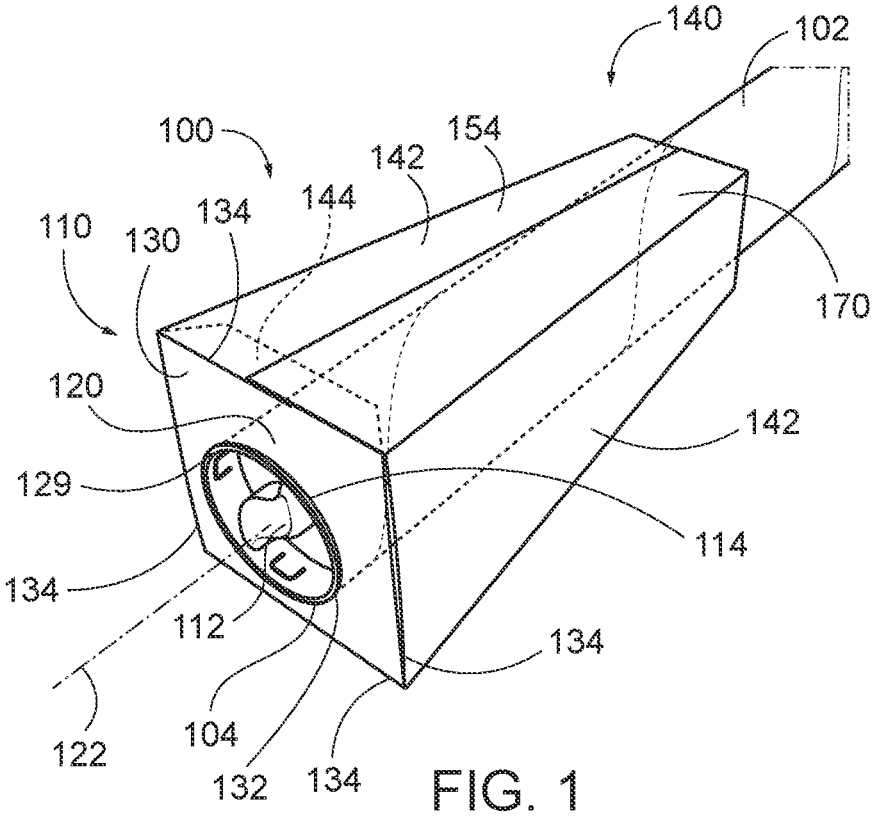
FIG. 1 is a partial perspective view of a non-roll end sleeve assembled on a tube.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 depicts a non-roll end sleeve 100 assembled on a tube 102. The tube 102 is received in a sleeve opening 104 of the non-roll end sleeve 100 at a partially closed end 110 of the non-roll end sleeve 100. The end is partially closed because the flap 150 that closes the non-roll end sleeve 100 includes a sleeve opening 104. The sleeve opening 104 is configured to close around the tube 102 so as to fix the non-roll end sleeve 100 with the tube 102 at the partially closed end 110. An end closure 112 as described in Applicant's U.S. Pat. No. 7,296,730 B2 is inserted into a tube opening 114 at an end 120 of the tube 102 to close off the tube opening 114. In an embodiment, the tube 102 is a seamless cylindrical tube having a circular profile along a central axis 122 of the tube 102, where the term "seamless" as used herein means that the tube 102 does not have a seam or a joint that runs parallel to the central axis 122 or otherwise along a longitudinal direction of the tube 102, and in this manner a seamless tube is different than a container that is formed by, for example, rolling or folding a piece of paperboard or paper-based material to form a hollow structure which is then taped or otherwise secured so as to have such an elongate seam.

As shown, an outer perimeter 129 of the end closure 112 is disposed on a front face 130 of the non-roll end sleeve 100 in which the sleeve opening 104 is defined, along an inner perimeter 132 of the sleeve opening 104. The end closure 112 is configured to abut the non-roll end sleeve 100 on the tube 102 in a longitudinal direction of the tube 102, and in this manner the end closure 112 is configured to retain the non-roll end sleeve 100 on the tube 102.

Rectangular edges 134 of the partially closed end 110 of the non-roll end sleeve 100 are configured to support the tube 102 on a supporting surface (not shown), such as a belt in a conveyor system. The non-roll end sleeve 100 is tapered inward toward the tube 102 along a longitudinal direction of the tube 102 from the partially closed end 110 to an opposite end 140 of the non-roll end sleeve 100 in a longitudinal direction of the tube 102. With this construction, when the tube 102 with the non-roll end sleeve 100 is positioned on a substantially horizontal surface and oriented substantially horizontally, the rectangular edges 134 of the partially closed end 110 of the non-roll end sleeve 100 are configured to rest on the substantially horizontal surface, with sides 142 of the non-roll end sleeve 100 spaced from the substantially horizontal surface.

The front face 130 of the non-roll end sleeve 100 includes a tab 144, shown in hidden lines, extended from the front face 130 and bent toward the tube 102. The tab 144 is folded under the sides 142 of the non-roll end sleeve 100 and fixed thereto with an adhesive for supporting the front face 130 of the non-roll end sleeve 100 on the sides 142 of the non-roll end sleeve 100.

Figure 2:
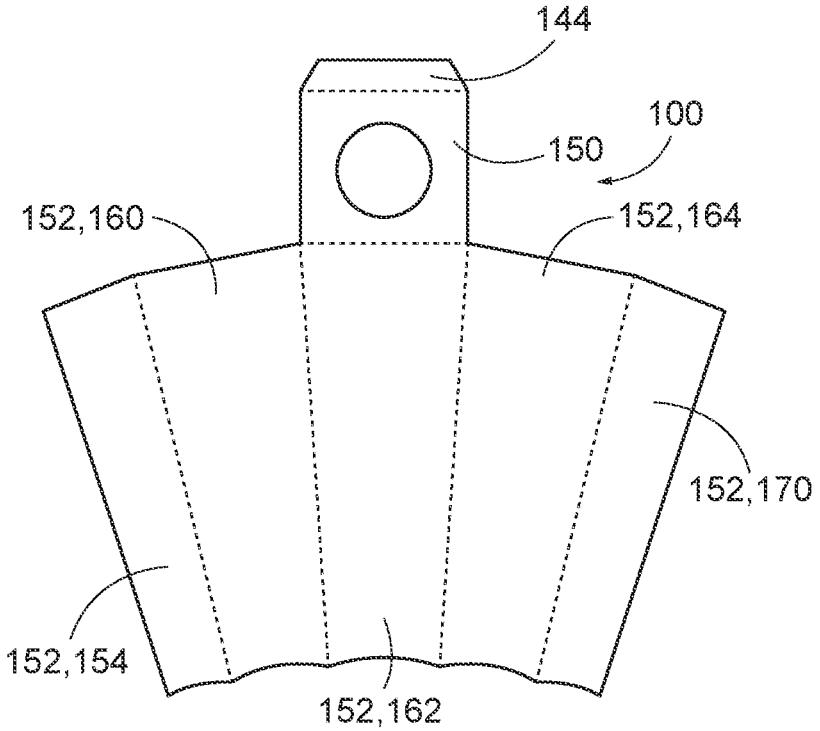
FIG. 2 is a front view of the non-roll end sleeve in a disassembled condition.

FIG. 2 depicts a front view of the non-roll end sleeve 100 disassembled from a tube, in an unfolded configuration. The non-roll end sleeve 100 includes a flap 150 configured to form the front face 130 when the non-roll end sleeve 100 is in a folded configuration. The flap 150 is shaped as a square and includes the tab 144 extended therefrom. While the flap 150 is depicted as square shaped, the flap 150 may alternatively be rectangular or otherwise shaped so as to partially close the non-roll end sleeve 100 around the tube 102 without departing from the scope of the present disclosure.

The non-roll end sleeve 100 also includes five panels 152 configured to form the sides 142 of the non-roll end sleeve 100 when the non-roll end sleeve 100 is in the folded configuration. The panels 152 are respectively shaped as trapezoids and organized relative to each other to form a tapered structure in the non-roll end sleeve 100 when the panels 152 are folded together in the folded configuration as in FIG. 1. More specifically, with continued reference to FIG. 2, a first panel 154 is continuous with and configured for being folded relative to a second panel 160, the second panel 160 is continuous with and configured for being folded relative to a third panel 162, the third panel 162 is continuous and configured for being folded relative to a fourth panel 164, and the fourth panel 164 is continuous with and configured for being folded relative to a fifth panel 170 such that the first panel 154 and the fifth panel 170 are in contact with each other and overlapping along the longitudinal direction of the tube 102 when the non-roll end sleeve 100 is in the folded configuration and assembled with the tube 102. When the non-roll end sleeve 100 is assembled with the tube 102 as in FIG. 1, the first panel 154 and the fifth panel 170 are fixed to each other with adhesive.

Figure 3:
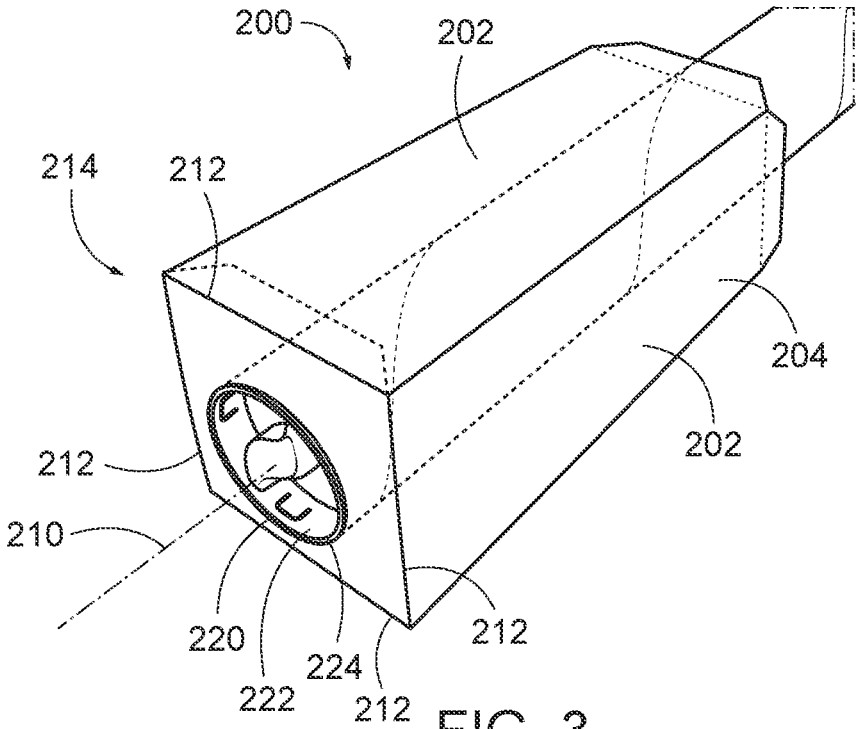
FIG. 3 is a partial perspective view of a non-roll end sleeve according to another aspect, assembled on a tube.

In an embodiment, a non-roll end sleeve is not tapered. To this end, FIG. 3 depicts a partial perspective view of a non-roll end sleeve 200 having sides 202 that are not tapered along the longitudinal direction of the tube 102. As such, an outer surface 204 of the non-roll end sleeve 200 in any cross-section taken through the non-roll end sleeve 200 perpendicular to a central axis 210 of the tube 102 would define a rectangle having a size and shape consistent with any other cross-section along the non-roll end sleeve 200 perpendicular to the central axis 210. With this construction, when the tube 102 with the non-roll end sleeve 200 is positioned on a substantially horizontal surface and oriented substantially horizontally, rectangular edges 212 of a partially closed end 214 of the non-roll end sleeve 200 and the sides 202 of the non-roll end sleeve 200 are configured to rest on the substantially horizontal surface.

In an embodiment, an inwardly facing tab (not shown) is formed in a sleeve opening 220 at the partially closed end 214 of the non-roll end sleeve 200. When the non-roll end sleeve 200 is assembled with the tube 102, the tube 102 is received in the sleeve opening 220 and the tab is pressed into a slot or notch (not shown) cut into the end 120 of the tube 102, and is further pressed against an inner side 222 of the tube 102 when the end closure 112 is inserted into the tube opening 114 to close off the tube opening 114. With this construction, the end closure 112 presses the tab from the non-roll end sleeve 200 against the inner side 222 of the tube 102 and prevent the non-roll end sleeve 200 from being displaced from a desired location on the tube 102. In an alternative embodiment, the tab can be folded over an edge 224 of the tube 102.

Figure 4:
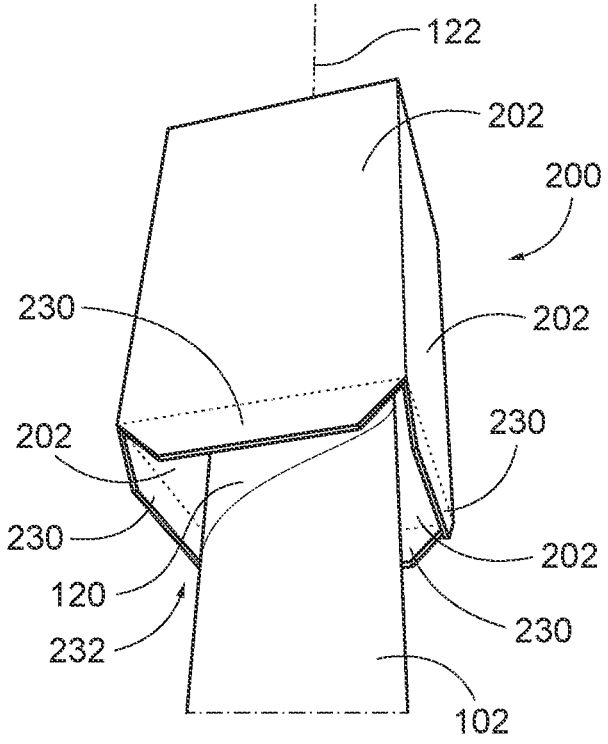
FIG. 4 is a partial perspective view of the non-roll end sleeve of FIG. 3.

FIG. 4 depicts a partial perspective view of the non-roll end sleeve 200 where, as shown, each side 202 of the non-roll end sleeve 200 respectively includes flaps 230 respectively disposed in an unbent position with respect to the non-roll end sleeve 200 such that each flap 230 is extended from the non-roll end sleeve 200 in the longitudinal direction of the tube 102, away from the end 120 of the tube 102. With each flap 230 respectively in the unbent position, an open end 232 of the non-roll end sleeve 200 is configured for receiving the tube 102 without a flap 230 contacting the tube 102.

Figure 5:
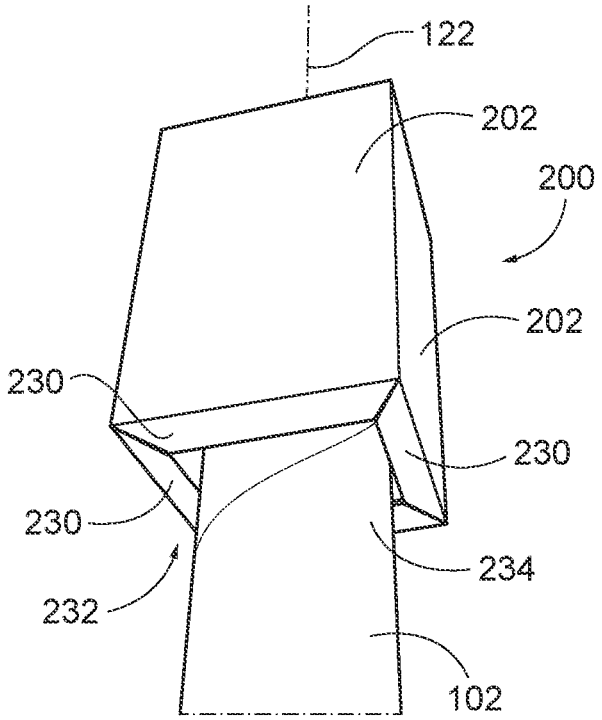
FIG. 5 is a partial perspective view of the non-roll end sleeve of FIG. 3.

FIG. 5 depicts a partial perspective view of the non-roll end sleeve 200 where each flap 230 is respectively bent inward from the corresponding side 202 of the non-roll end sleeve 200 into a bent position directed toward the central axis 122 of the tube 102. As shown, each flap 230 contacts an outer surface 234 of the tube 102 so as to fix the open end 232 of the non-roll end sleeve 200 with the tube 102, thereby supporting the tube 102 in the non-roll end sleeve 200 at the open end 232. Unless otherwise stated, the non-roll end sleeve 200 functions in a similar manner and has similar features as the non-roll end sleeve 100.

Figure 6:
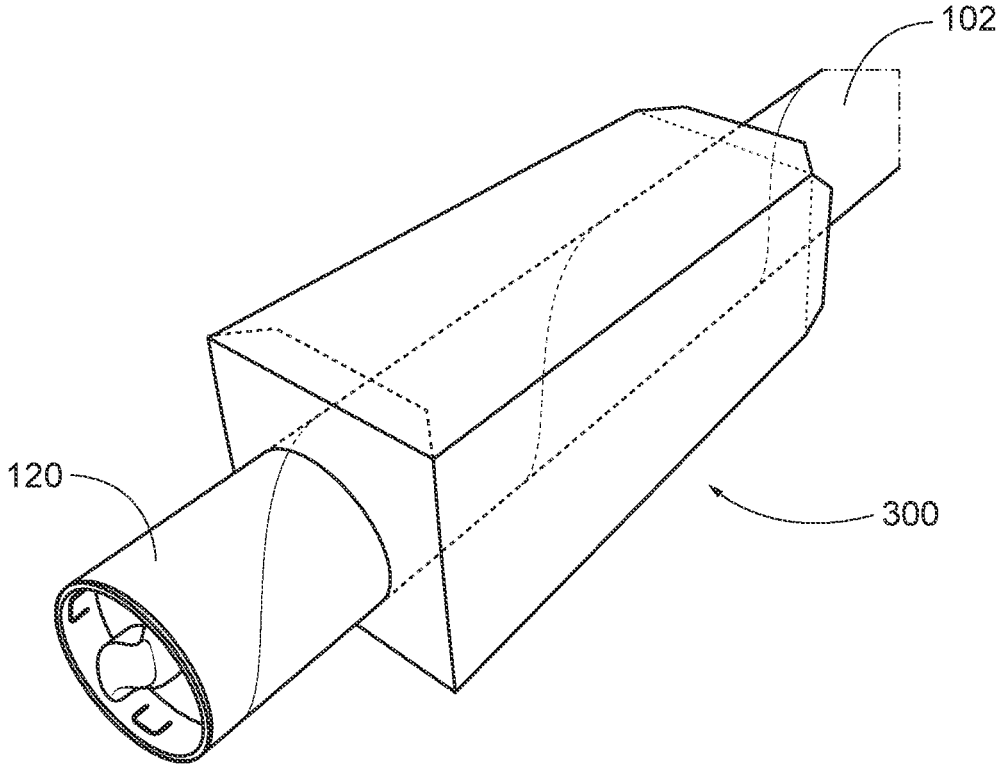
FIG. 6 is a partial perspective view of a non-roll end sleeve according to another aspect, assembled on a tube.

In an embodiment, a non-roll end sleeve is configured for assembly on a tube, spaced from the end of the tube. To this end, FIG. 6 depicts a partial perspective view of a non-roll end sleeve 300 assembled on the tube 102 where the non-roll end sleeve 300 is spaced from the end 120 of the tube 102 in the longitudinal direction of the tube 102, and spaced from the end closure in the longitudinal direction of the tube 102. Unless otherwise stated, the non-roll end sleeve 300 functions in a similar manner and has similar features as the non-roll end sleeve 100.

Figure 7:
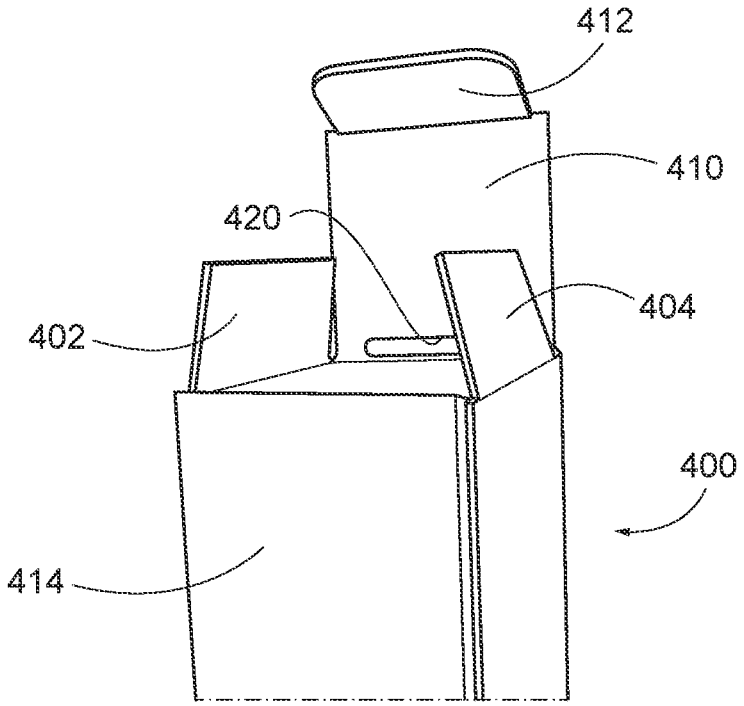
FIG. 7 is a partial perspective view of a non-roll end sleeve according to another aspect.

In an embodiment, a non-roll end sleeve includes a front face configured to close over a tube opening. To this end, FIG. 7 depicts a partial perspective view of a non-roll end sleeve 400 including a first flap 402 and a second flap 404 as a pair of side flaps configured for being folded toward each other, over the end 120 of the tube 102 in the longitudinal direction of the tube 102. The non-roll end sleeve 400 also includes a third flap 410 as a cover configured for being folded over the first flap 402 and the second flap 404 in the longitudinal direction of the tube 102, on a side of the first flap 402 and the second flap 404 opposite from the end 120 of the tube 102. The third flap 410 includes a third flap tab 412 extended therefrom and configured for being folded from the third flap 410 and inserted between the first flap 402, the second flap 404, and a side 414 of the non-roll end sleeve 400 opposite from the third flap 410 such that the third flap tab 412 retains the third flap 410 folded over the first flap 402, the second flap 404, and the end 120 of the tube 102 when the non-roll end sleeve 400 is assembled with the tube 102. The third flap 410 also includes a third flap slot 420 defined therethrough, along a side from which the third flap 410 extends.

Figure 8:
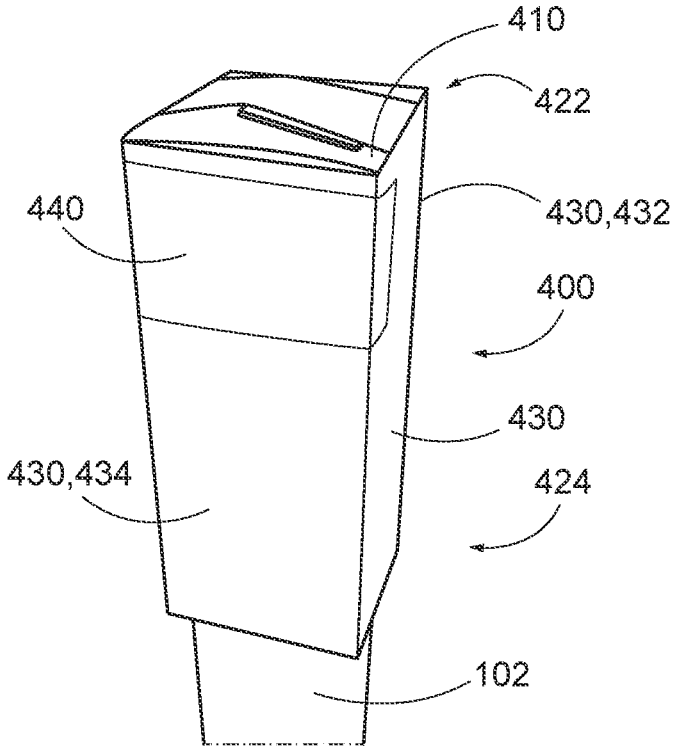
FIG. 8 is a partial perspective view of the non-roll end sleeve of FIG. 7, assembled on a tube.

FIG. 8 depicts a partial perspective view of the non-roll end sleeve 400 assembled on the tube 102. As shown, the third flap 410 is folded over the end 120 of the tube 102 and forms a closed end 422 of the non-roll end sleeve 400 over the end 120 of the tube 102 in the longitudinal direction of the tube 102. An opposite end 424 of the non-roll end sleeve 400 is located across sides 430 of the non-roll end sleeve 400 in the longitudinal direction of the tube 102.

The sides 430 of the non-roll end sleeve 400 include a bottom side 432 of the non-roll end sleeve 400 positioned on a supporting surface (not shown) for the non-roll end sleeve 400, such as a top surface of a conveyor belt or storage shelf. The sides 430 of the non-roll end sleeve 400 also include a top side 434 of the non-roll end sleeve 400 defining a side of the non-roll end sleeve 400 opposite from the bottom side 432. The top side 434 of the non-roll end sleeve 400 includes a predefined location for a label 440 corresponding with the tube 102. When the bottom side 432 of the non-roll end sleeve 400 supporting the non-roll end sleeve 400 in an upright position, the label 440 on the top side 434 of the non-roll end sleeve 400 is visible from a top view of the non-roll end sleeve 400.

Figure 9:
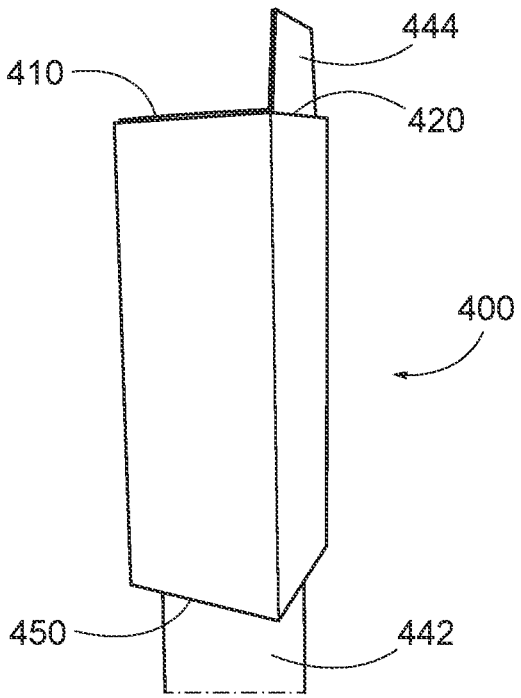
FIG. 9 is a partial perspective view of a non-roll end sleeve according to another aspect, assembled on a tube.

In an embodiment, a tube flap extended from a tube extends through a closed end of a non-roll sleeve. To this end, FIG. 9 depicts a partial perspective view of the non-roll end sleeve 400 disposed on a tube 442 with a tube flap 444 received in and disposed through the third flap slot 420. The third flap slot 420 is configured for receiving the tube flap 444 when the third flap 410 is folded over an end 450 of the tube 442 and in this manner retaining the third flap 410 and the non-roll end sleeve 400 on the tube 442. With the tube flap 444 extended through the third flap slot 420, the tube flap 444 retains the non-roll end sleeve 400 on the tube 442 in a longitudinal direction of the tube 442, and fixes a radial position of the tube 442 with respect to the non-roll end sleeve 400. Unless otherwise stated, the non-roll end sleeve 400 and the tube 442 respectively function in a similar manner and have similar features as the non-roll end sleeve 100 and the tube 102.

Figure 10:
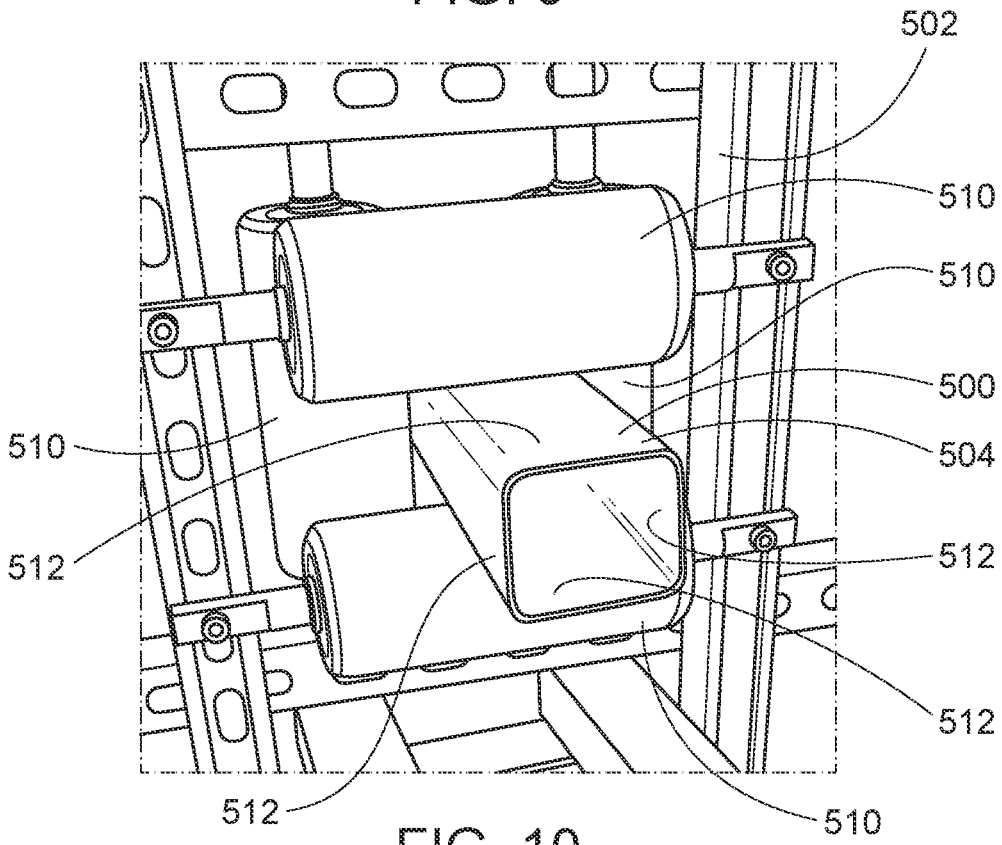
FIG. 10 is a partial perspective view of a tube according to another aspect.

In an embodiment, a tube is shaped to have a substantially square shaped profile. To this end, FIG. 10 depicts a partial perspective view of a tube 500 disposed in a press 502 with an end 504 of the tube 500 pressed between four rollers 510 such that the tube 500 is shaped to have a substantially square shaped profile along a longitudinal direction of the tube 500 at the end of the tube 500. It will be appreciated that other forming methods can be used (e.g., sliding the paper tube on a former and rolling/pressing the tube onto the former to define the corners of the profile).

In a particularly preferred method of shaping a paper tube employed as the tube 500, and the paper tube is formed with a sufficiently high moisture content such that the tube 500 is pliable for being shaped and subsequently dried having a square profile along the longitudinal direction of the tube 500. In an embodiment, the paper used to form the tube has a 5-6% moisture content and an adhesive in the tube 500 has a relatively high water content such that when the tube 500 is initially manufactured, the tube 500 has a moisture content of about 20% to enable shaping the tube 500 with a square profile along the longitudinal direction of the tube 500. In a dried condition where the tube 500 is sufficiently rigid and has sufficient structural integrity so as to reasonably maintain its shape as a shipping container, the tube 500 has a moisture content of about 8%. It will be appreciated that forming can be performed when the tubes are in a dried condition, if desired. But results obtained when forming is performed on "dry" tubes are generally not as optimal as when forming is performed on "wet" tubes.

While the tube 500 is depicted as being pressed and formed into a square profile, rollers 510 in the press 502 can be otherwise organized to compress the tube 500 into a rectangle having sides that in sum are equal to a circumference of the seamless paper tube without departing from the scope of the present disclosure. Notably, because a circumference of the tube 500 remains constant when pressed into a square profile, predicting a length of sides 512 of the tube 500 in a square profile at the end 504, based on the size of the tube 500 and the tube having a circular profile before being pressed, is possible by measuring a diameter of the tube 500, calculating a corresponding circumference of the tube 500, and dividing the calculated circumference by four. Also, a distance between opposite corners 520 of the tube 500 can be calculated by taking a square root of a sum of squares of two consecutive sides.

Further, the number of rollers 510 employed in pressing the tube 500 can be adjusted to compress the tube 500 into a variety of profiles including but not limited to polygonal profiles without departing from the scope of the present disclosure. For example, three rollers 510 can be arranged to press the tube 500 into a triangular profile, and alternatively six rollers 510 can be arranged to press the tube 500 into a hexangular profile. In this manner, the end 504 of the tube 500 can be pressed to a profile having N sides 512 formed from N rollers 510, where N is an integer greater than 2. In an embodiment, N is specifically an integer selected from a range from 3 to 8. In a further embodiment, N is 4, 5, 6, 7, or 8.

Figure 11:
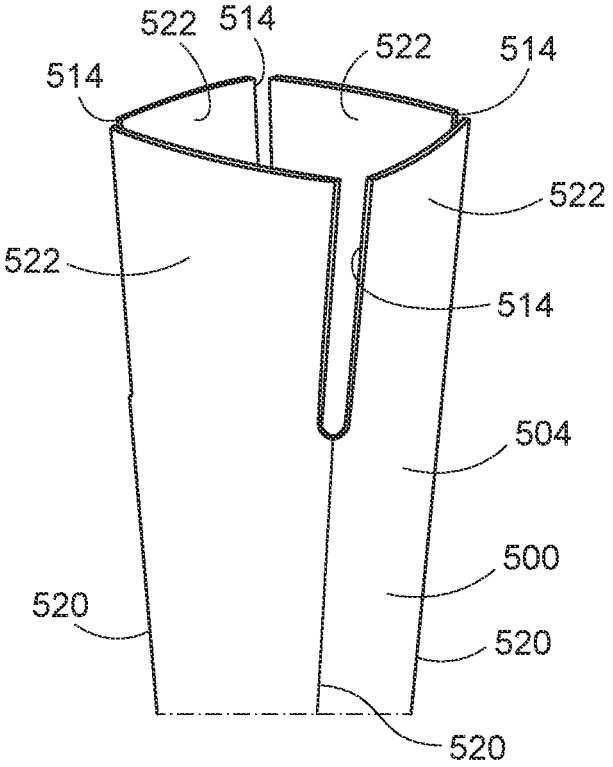
FIG. 11 is a partial perspective view of the tube of FIG. 10.

FIG. 11 depicts a partial perspective view of the tube 500, which has been squared at the end 504 and has slits 514 cut at squared corners 520 of the end 504 to form four flaps 522 configured for being folded inward, into the square profile of the end 504 of the tube 500. The slits 514 have a length that is about half of a circumference of the tube 500.

Figure 12:
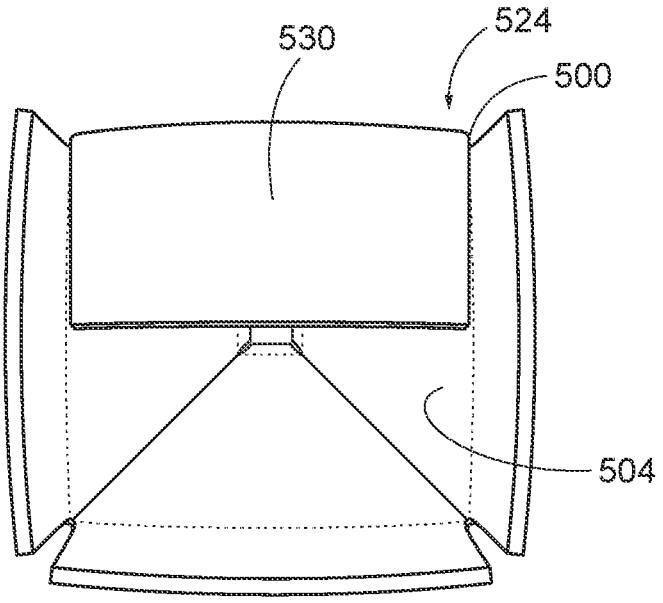
FIG. 12 is a top view of the tube of FIG. 10.
Figure 13:
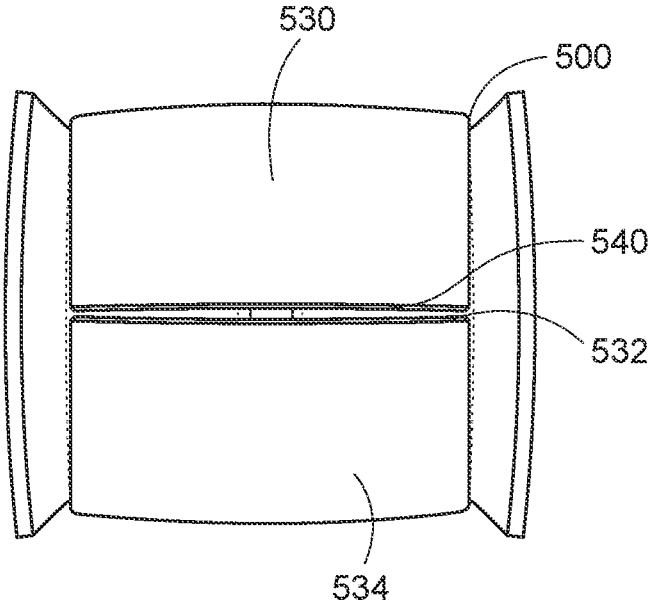
FIG. 13 is a top view of the tube of FIG. 10.
Figure 14:
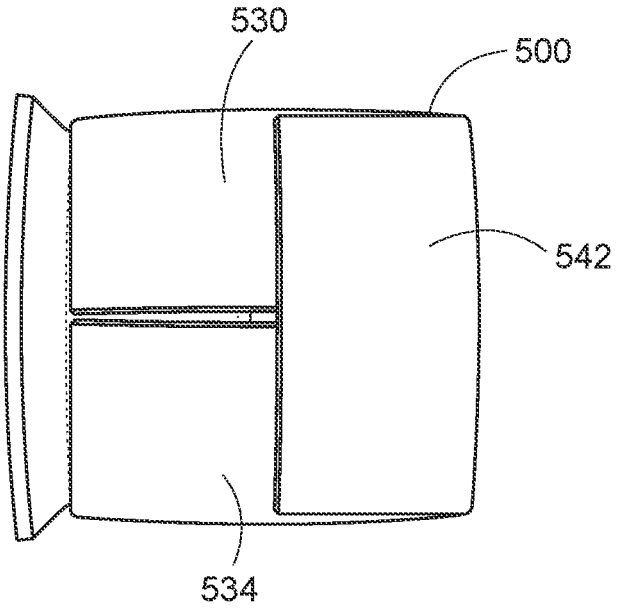
FIG. 14 is a top view of the tube of FIG. 10.
Figure 15:
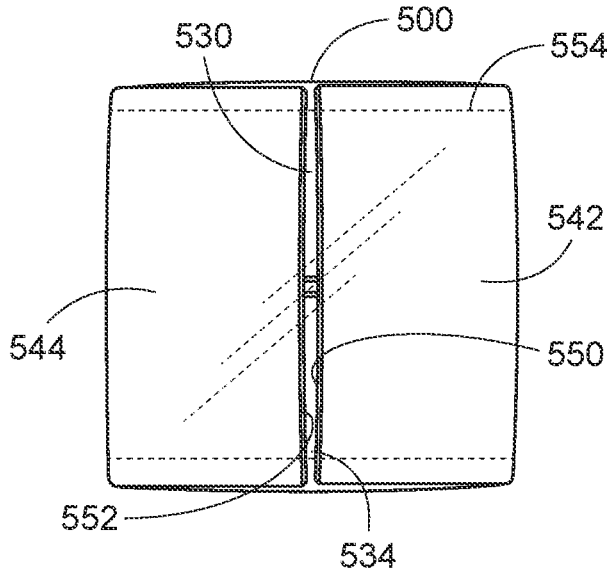
FIG. 15 is a top view of the tube of FIG. 10.

FIGS. 12-15 depict the end 504 of the tube 500 folded into an end closure 524. As shown in FIG. 12, a portion of the tube 500 between two consecutive slits 514 taken along a circumference of the tube 500 forms a first flap 530 and is folded inward. The first flap 530 spans approximately half of the diameter of a square formed by compressing the tube 500 into a square. With this, as shown in FIG. 13, a distal edge 532 of an opposing second flap 534 formed between two consecutive slits 514, folded inward toward the first flap 530, meets a distal edge 540 of the first flap 530. FIG. 14 depicts a third flap 542 folded inward with respect to the tube 500 over the first flap 530 and the second flap 534 in the longitudinal direction of the tube 500. The third flap 542 spans approximately half of the diameter of a square formed by compressing the tube 500 into a square and when folded over the first flap 530 and the second flap 534, and covers half of the first flap 530 and half of the second flap 534 in the longitudinal direction of the tube 500. As shown in FIG. 15, a fourth flap 544 is folded inward with respect to the tube 500, over the second flap 534 and the third flap 542 in the longitudinal direction of the tube 500. The fourth flap 544 spans approximately half of the diameter of a square formed by compressing the tube 500 into a square and when folded over the first flap 530 and the second flap 534 such that a distal edge 550 of the third flap 542 meets a distal edge 552 of the fourth flap 544 when the third flap 542 and the fourth flap 544 are folded inward toward each other with respect to the tube 500. As such, the fourth flap 544 covers half of the second flap 534 and half of the third flap 542 in the longitudinal direction of the tube 500.

Adhesive tape 554 shown in hidden lines is employed to fix the third flap 542 and the fourth flap 544 folded over the first flap 530 and the second flap 534. Notably, adhesive and stables may be employed in combination with or alternative to the adhesive tape 554 in fixing the first flap 530, the second flap 534, the third flap 542, and the fourth flap 544 folded inward with respect to the tube 500 without departing from the scope of the present disclosure. In an embodiment, adhesive is disposed on an outside of the first flap 530, an outside of the second flap 534, an inside of the third flap 542, and an inside of the fourth flap 544 in the longitudinal direction of the tube 500, and the adhesive tape 554 is a release tape disposed on an outside of the third flap 542 and the fourth flap 544 while the adhesive fixes the inside of the third flap 542 and the inside of the fourth flap 544 with the outside of the first flap 530 and the outside of the second flap 534. The adhesive tape 554 can be removed from the third flap 542 and the fourth flap 544 when the adhesive fixing the first flap 530, the second flap 534, the third flap 542, and the fourth flap 544 folded inward with respect to the tube 500 dries.

Figure 16:
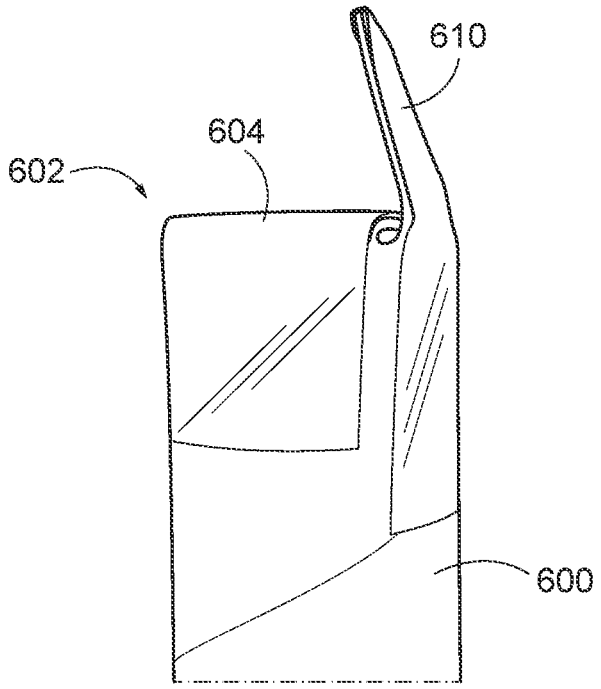
FIG. 16 is a partial side view of a tube according to another aspect.
Figure 17:
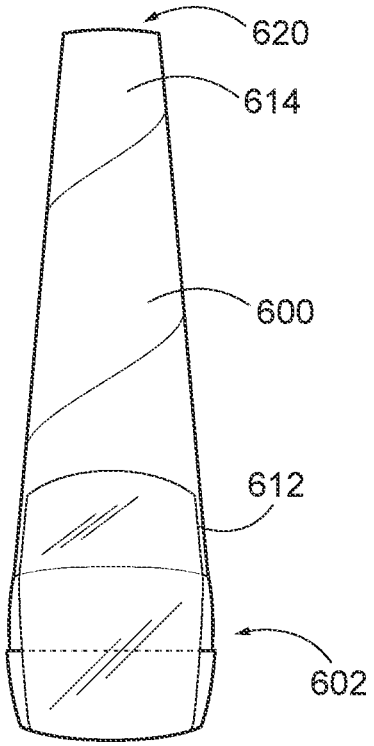
FIG. 17 is a perspective view of the tube of FIG. 10.

In an embodiment, a tube end closure is folded with a flap extending outward therefrom in a longitudinal direction of the tube. To this end, FIG. 16 depicts a partial side view of a tube 600 having an end closure 602 formed from a first flap 604, and having a second flap 610 extending from the end closure 602 in a longitudinal direction of the tube 600. As shown in FIG. 17, an end 612 of the tube 600 is pressed and folded into the end closure 602, and an opposite end 614 of the tube 600 is similarly pressed and folded into an opposite end closure 620. Unless otherwise stated, the opposite end 614 of the tube 600 functions in a similar manner and has features similar to the end 612 of the tube 600. The end 612 of the tube 600 and the opposite end 614 of the tube 600 are pressed and folded such that the tube 600 has a circular profile between the end 612 of the tube 600 and the opposite end 614 of the tube 600 along the longitudinal direction of the tube 600. Unless otherwise stated, the tube 600 functions in a similar manner and has similar features as the tube 102.

Figure 18:
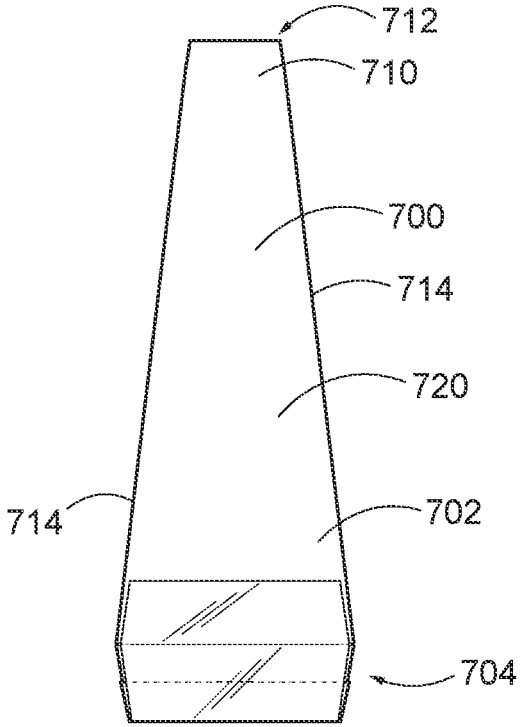
FIG. 18 is a partial perspective view of a tube according to another aspect.

In an embodiment, a tube is shaped to have a polygonal profile along a longitudinal direction of the tube, along a length of the tube from an end of the tube to an opposite end of the tube. To this end, FIG. 18 depicts a partial perspective view of a tube 700 having a rectangular profile from an end 702 of the tube 700 forming an end closure 704 to an opposite end 710 of the tube 700 forming an opposite end closure 712. The substantially rectangular profile of the tube 700 includes squared corners 714 disposed along the longitudinal direction of the tube 700, the corners 714 being interposed between and separating sides 720 of the tube 700. Unless otherwise stated, the tube 700 functions in a similar manner and has similar features as the tube 102.

Figure 19:
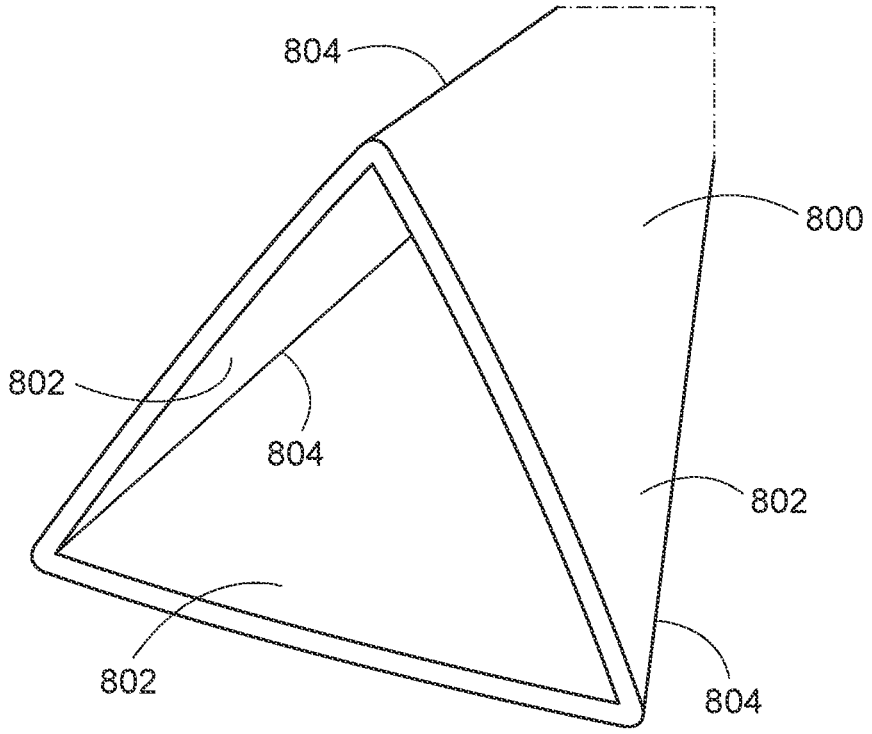
FIG. 19 is a partial perspective view of a tube according to another aspect.

In an embodiment, a tube is shaped to have a triangular profile along a longitudinal direction of the tube. To this end, FIG. 19 depicts a partial perspective view of a tube 800 shaped to have a triangular profile including three sides 802 elongated in a longitudinal direction of the tube 800 and respectively interposed between and separating three corners 804 at an end of the tube 800.

Figure 20:
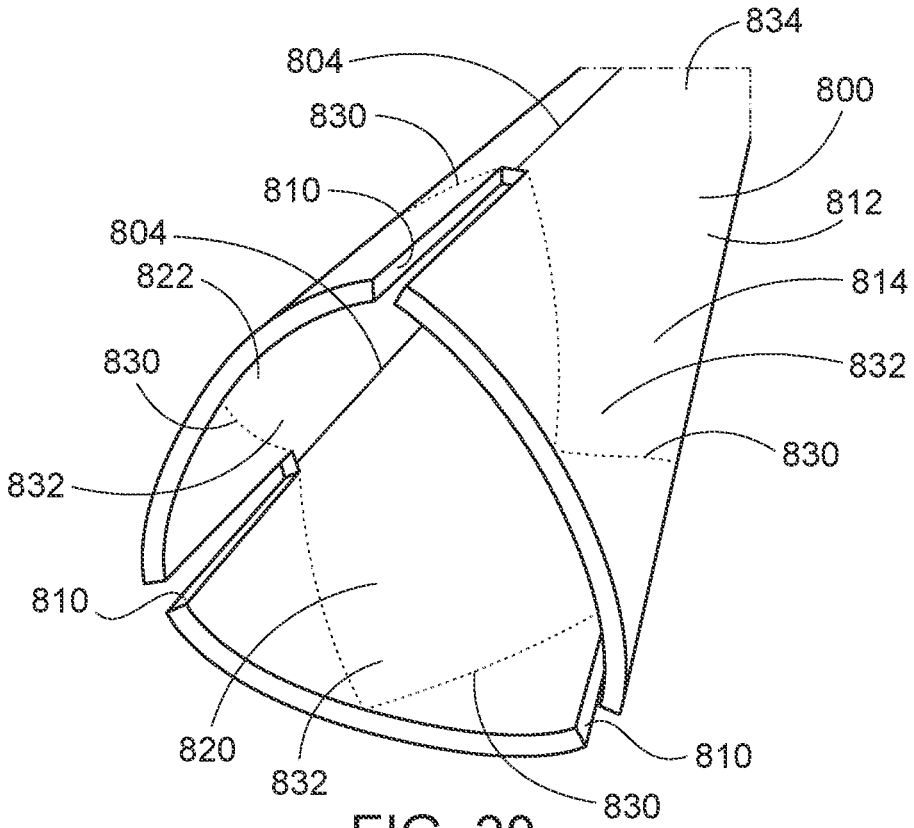
FIG. 20 is a partial perspective view of the tube of FIG. 19.

FIG. 20 is a partial perspective view of the tube 800 having slits 810 cut into the end 812 of the tube 800 respectively along the corners 804 of the tube 800. The slits 810 are interposed between and separate the sides 802 of the tube 800 at the end 812 of the tube 800 such that the elongated surfaces respectively form a first flap 814, a second flap 820, and a third flap 822 located at the end 812 of the tube 800 and configured for being folded inward with respect to the tube 800.

The first flap 814, the second flap 820, and the third flap 822 are configured for folding inward with respect to the tube 800 and overlap each other to form an end closure. To this end, the first flap 814, the second flap 820, and the third flap 822 are configured for being folded or cut along dashed lines 830 which respectively delineate a triangular area 832 of the corresponding flap 814, 820, 822, the triangular area being configured for covering the triangular profile of the tube 800 in the longitudinal direction of the tube 800.

Notably, by respectively removing material from the first flap 814, the second flap 820, and the third flap 822 to form a triangular flap corresponding with the triangular profile of the tube 800, the first flap 814, the second flap 820, and the third flap 822 are respectively configured for being folded inward with respect to the tube 800 to form an end closure without extending beyond the triangular profile of the tube 800 in a radial direction of the tube 800. In an embodiment, the second flap 820 is cut into a triangle, and the first flap 814 and the third flap 822 are folded respectively along the corresponding dashed lines 830 to form a triangular area, where folded material of the first flap 814 is inserted into the end 812 of the tube 800 and folded material from the third flap 822 is folded around an outside surface 834 of the tube 800 at the end 812. Unless otherwise stated, the tube 800 functions in a similar manner and has similar features as the tube 102.

Figure 21:
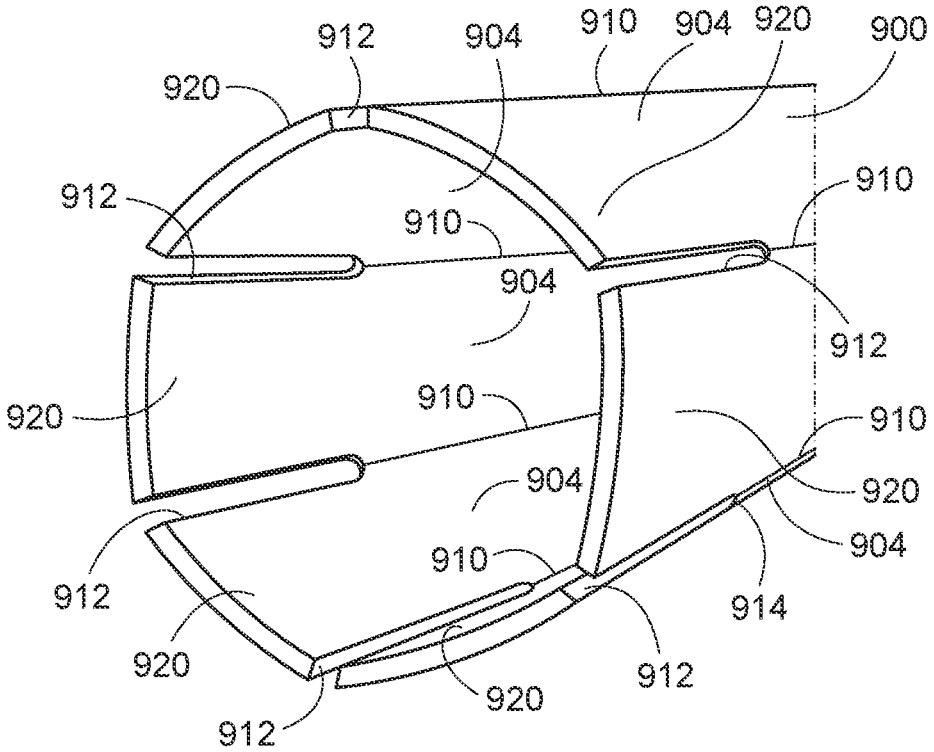
FIG. 21 is a partial perspective view of a tube according to another aspect.
Figure 22:
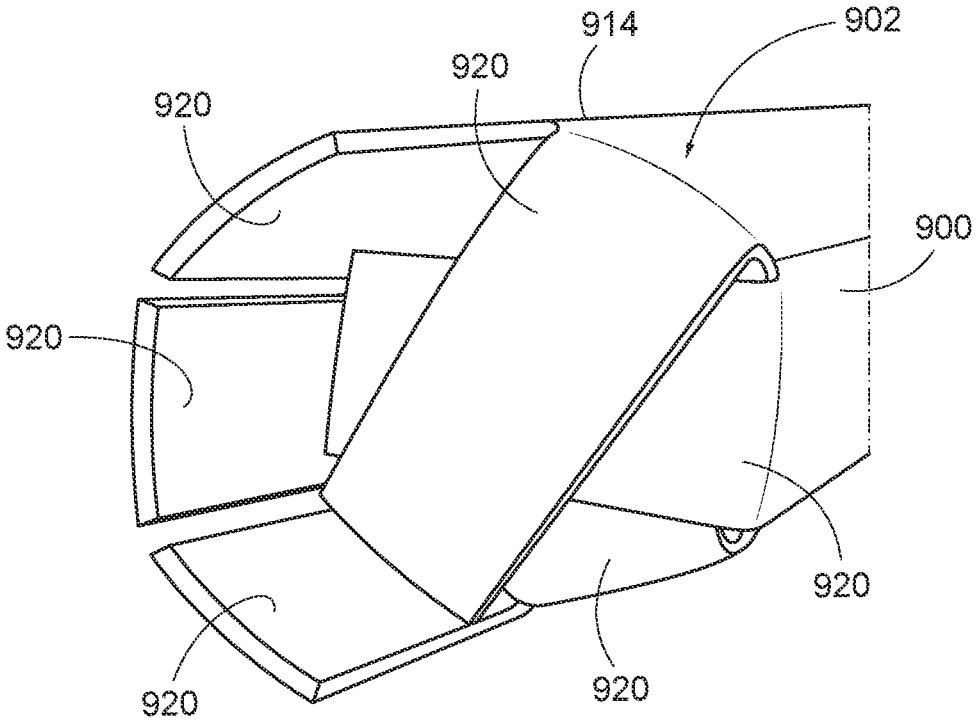
FIG. 22 is a partial perspective view of the tube of FIG. 21.
Figure 23:
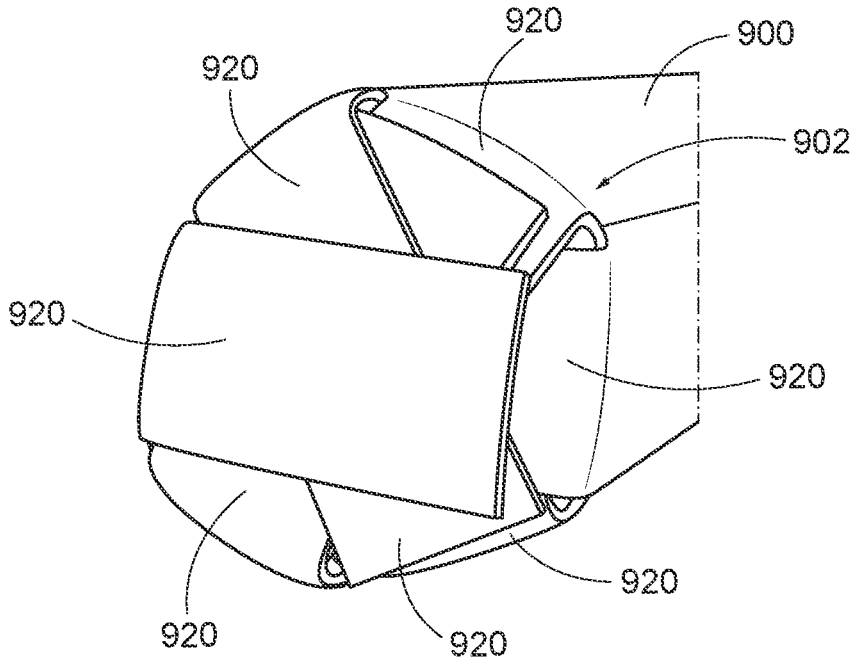
FIG. 23 is a partial perspective view of the tube of FIG. 21.
Figure 24:
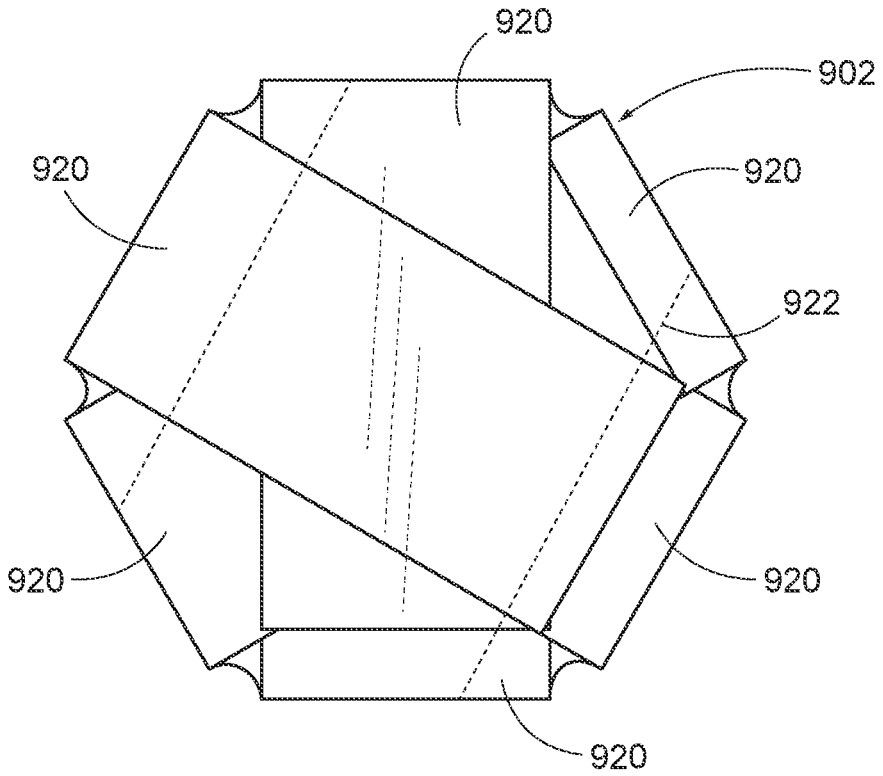
FIG. 24 is a top view of the tube of FIG. 21.

In an embodiment, a tube is shaped to have a hexangular profile along a longitudinal direction of the tube. To this end, FIGS. 21-24 depict a tube 900 forming an end closure 902 in a hexangular shape. As shown in FIG. 21, the tube 900 has a hexangular profile including six sides 904 elongated in a longitudinal direction of the tube 900, the sides 904 respectively interposed between and separating six corners 910 at an end of the tube 900. Slits 912 cut into an end 914 of the tube 900 along the corners 910 respectively form flaps 920 from the sides 904 located between consecutive slits 912. The flaps 920 are configured for being folded inward with respect to the tube 900, in a radial direction of the tube 900 so as to form the end closure 902. In an embodiment, the end 914 of the tube 900 is not formed to have a hexangular profile before the flaps 920 are folded inward to form the end closure 902. FIG. 22 depicts the tube 900 where three consecutive flaps 920 are folded inward, partially forming the end closure 902 at the end 914 of the tube 900. FIG. 23 depicts the tube 900 where the flaps 920 are folded inward, in the radial direction of the tube 900, forming the end closure 902. As shown in FIG. 24, the flaps 920 are fixed in the end closure 902 by adhesive tape 922. Notably, the flaps 920 may be fixed in the end closure 902 with adhesive or staples in combination with or alternative to the adhesive tape 922 without departing from the scope of the present disclosure. Unless otherwise stated, the tube 900 functions in a similar manner and has similar features as the tube 102.

Figure 25:
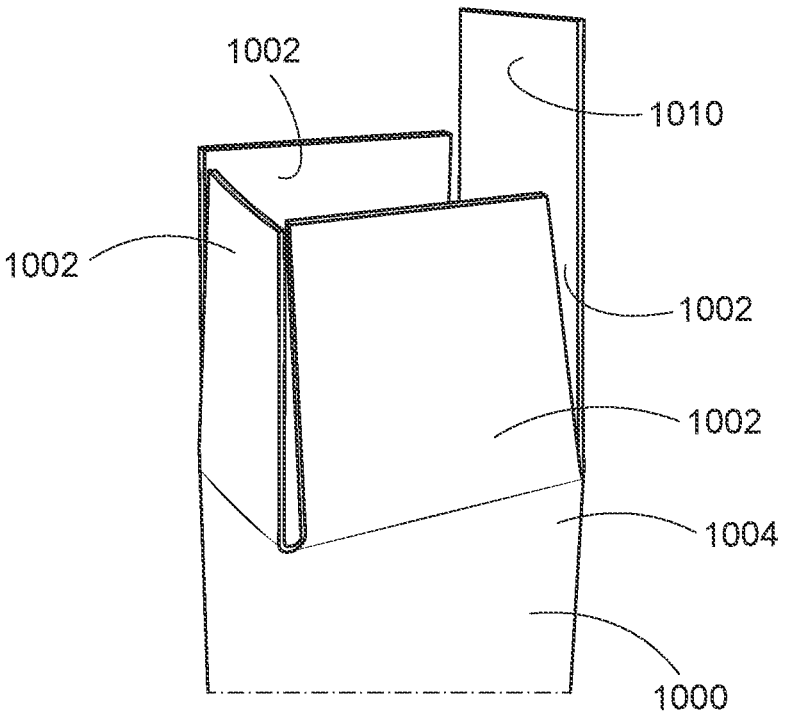
FIG. 25 is a partial perspective view of a tube according to another aspect.
Figure 26:
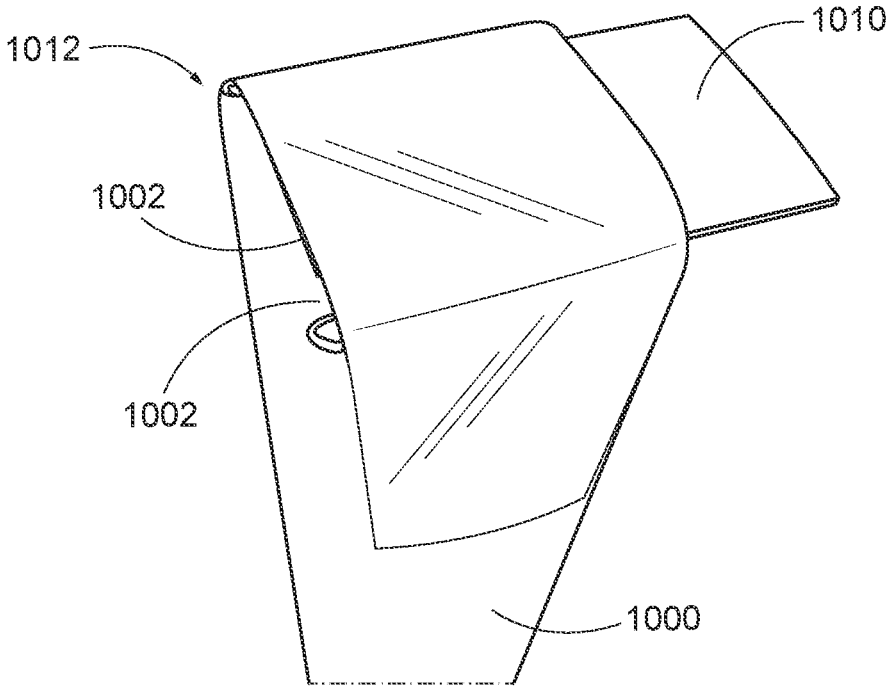
FIG. 26 is a partial perspective view of the tube of FIG. 25.

In an embodiment, a tube includes a flap that is sufficiently elongated so as to extend outward beyond an end closure of the tube in a radial direction of the tube. To this end, FIG. 25 depicts a partial perspective view of a tube 1000 formed including four flaps 1002 at an end 1004 of the tube 1000. The flaps 1002 are configured for being folded with respect to the tube 1000, at the end 1004 of the tube 1000. One of the flaps 1002 is an elongated flap 1010 having a length greater than a diameter of the tube 1000. With this construction, as shown in FIG. 26, the elongated flap 1010 extends in a radial direction of the tube 1000, beyond an end closure 1012 formed by the flaps 1002 when the elongated flap 1010 is folded into the end closure 1010. By extending beyond the end closure 1012 in the radial direction of the tube 1000, the elongated flap 1010 forms a non-roll extension in the radial direction of the tube 1000. The flaps 1002, including the elongated flap 1010 as the non-roll extension, are formed integrally with the tube 1000. Unless otherwise stated, the tube 1000 functions in a similar manner and has similar features as the tube 102.

Figure 27:
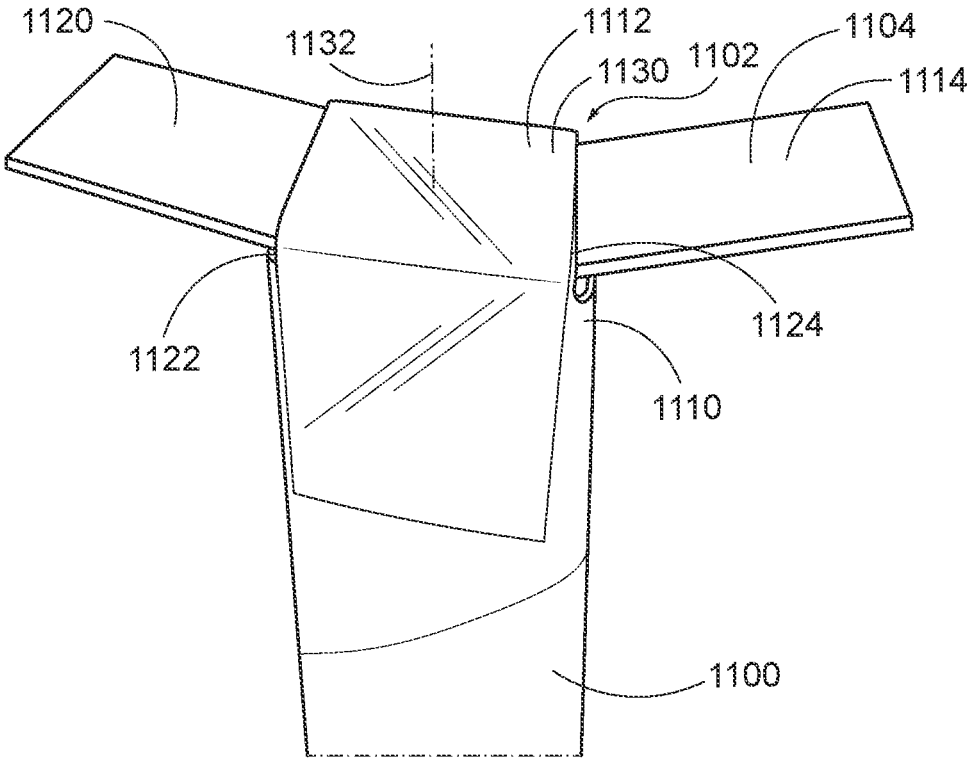
FIG. 27 is a partial perspective view of a tube according to another aspect.

In an embodiment, a non-roll extension is inserted in an end closure of a tube and extends from multiple sides of the tube. To this end, FIG. 27 depicts a partial perspective view of a tube 1100 including an end closure 1102 with a non-roll extension 1104 inserted therein. The non-roll extension 1104 is a strip of corrugated fiberboard placed at an end 1110 of the tube 1100, inserted in the end closure 1102, and fixed in the end closure 1010 with adhesive tape 1112 such that a first end 1114 and a second end 1120 of the non-roll extension 1104 respectively extend from opposing sides of the end 1110 of the tube 1100. As depicted, the non-roll extension 1104 is fixed between an inner flap 1122 and an outer flap 1124 in the end closure 1102, however the non-roll extension 1104 can be fixed on an outside surface 1130 of the outer flap 1124 without departing from the scope of the present disclosure. The non-roll extension 1104 is flexible in a longitudinal direction of the tube 1100 and relatively rigid in a direction perpendicular to the longitudinal direction of the tube 1100 so as to inhibit the tube 1100 from rolling about a central axis 1132 of the tube 1100, but being able to bend inward in the longitudinal direction of the tube 1100 (i.e., toward the tube) for a relatively compact storage configuration of the tube (the non-roll extension would spring outwardly into the non-roll configuration when not in the bent/inwardly biased storage configuration).

The non-roll extension 1104 is formed from a material sufficiently elastic to bend in the longitudinal direction of the tube 1100 and maintain a spring bias toward a radial direction of the tube 1100 so as to automatically return to an extended position with respect to the tube 1100 when not restricted in the storage configuration. While the non-roll extension 1104 is disclosed as being formed from fiberboard, the non-roll extension 1104 may alternatively be formed from a material with sufficient elasticity to similarly exert a spring bias in the radial direction of the tube 1100, such as a polymer material. Unless otherwise stated, the tube 1100 functions in a similar manner and has similar features as the tube 102.

Figure 28:
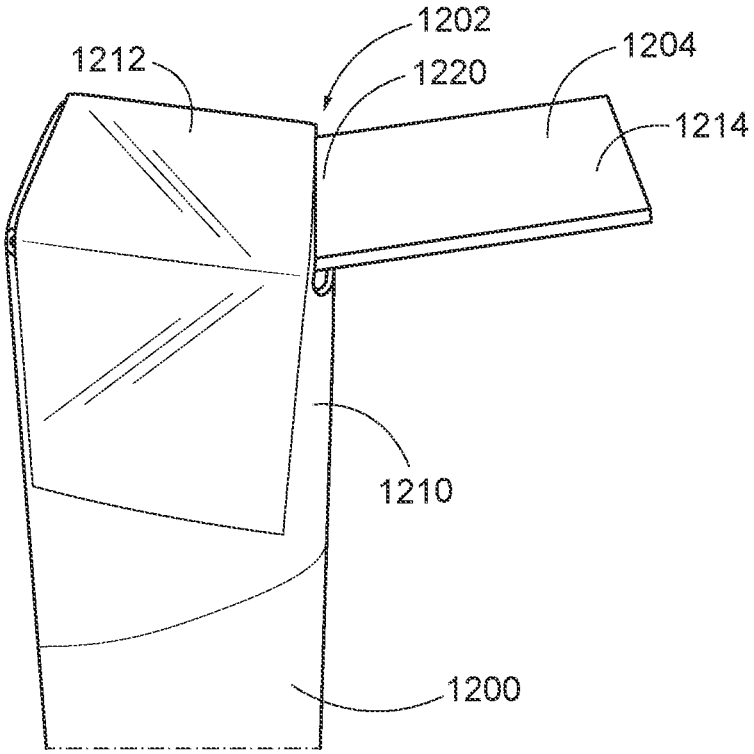
FIG. 28 is a partial perspective view of a tube according to another aspect.
Figure 29:
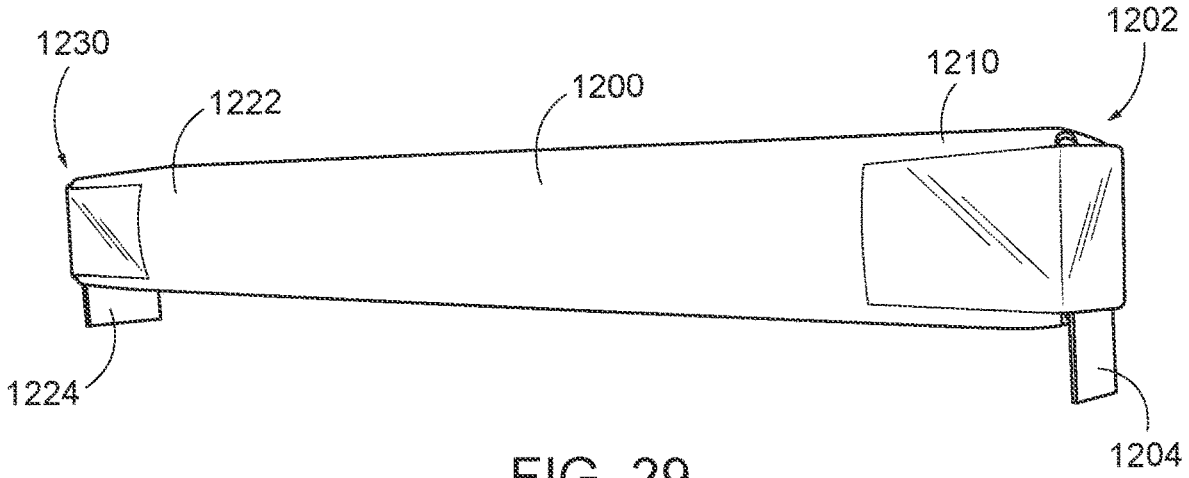
FIG. 29 is a perspective view of a tube according to another aspect.

In an embodiment, a non-roll extension is inserted in an end closure of a tube and extends from a side of the tube. To this end, FIG. 28 depicts a partial perspective view of a tube 1200 including an end closure 1202 with a non-roll extension 1204 inserted therein. The non-roll extension 1204 is a strip of corrugated fiberboard placed at an end 1210 of the tube 1200, inserted in the end closure 1202, and fixed in the end closure 1202 with adhesive tape 1212 such that a first end 1214 of the non-roll extension 1204 extends from a side of the tube 1200 and a second end 1220 of the non-roll extension 1204 is inserted in the end closure 1202. As shown in FIG. 29, an opposite end 1222 of the tube 1200 similarly includes an opposite non-roll extension 1224 inserted therein at an opposite end closure 1230. Unless otherwise stated, the opposite end 1222 of the tube 1200, the opposite non-roll extension 1224, and the opposite end closure 1230 respectively function in a similar manner and have similar features as the end 1210 of the tube 1200, the non-roll extension 1204, and the end closure 1202. Also, unless otherwise stated, the tube 1200 functions in a similar manner and has similar features as the tube 102.

Figure 30:
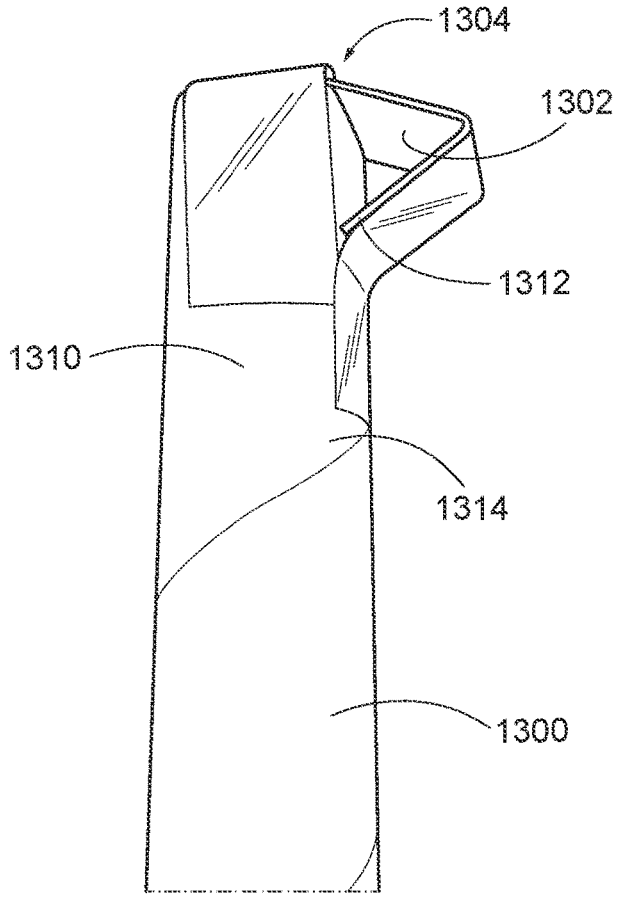
FIG. 30 is a partial perspective view of a tube according to another aspect.

In an embodiment, a non-roll extension extending from an end closure of a tube is folded back and fixed to a side of the tube. To this end, FIG. 30 depicts a partial perspective view of a tube 1300 with a non-roll extension 1302 inserted in an end closure 1304 at an end 1310 of the tube 1300. The non-roll extension 1302 extends radially outward from the end closure 1304 with respect to the tube 1300, and is bent back toward the tube 1300 along a longitudinal direction of the tube 1300 with a distal end 1312 of the non-roll extension 1302 fixed to an exterior surface 1314 of the tube 1300 at a side of the tube 1300. The non-roll extension 1302 is bent to form a relatively rigid triangular shape. As depicted, the non-roll extension 1302 extends from one side of the tube 1300, however, the non-roll extension may extend from multiple side of the tube 1300 without departing from the scope of the present disclosure. Unless otherwise stated, the tube 1300 functions in a similar manner and has similar features as the tube 102.

It will be appreciated that various embodiments of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A shipping container comprising:

a seamless cylindrical paper tube having a central axis and first and second ends each defining an opening;

an end closure that is received within and closes the opening defined by one of the first and second ends of the tube; and a non-roll sleeve disposed on the tube at the end of the tube defining the opening within which the end closure is received;

wherein the non-roll sleeve has a rectangular cross-section perpendicular to the central axis of the tube when disposed on the tube, and wherein the non-roll sleeve disposed on the tube covers only a portion but not all of the tube, leaving a central portion of the tube exposed.

2. The shipping container according to claim 1, wherein the non-roll sleeve disposed on the tube narrows along its length in a direction away from the end of the tube.

3. The shipping container according to claim 1, wherein the non-roll sleeve has the same cross-section at any point along the central axis of the tube when disposed on the tube.

4. The shipping container according to claim 1, wherein the end closure secures the non-roll sleeve on the tube.

5. The shipping container according to claim 1, wherein the rectangular cross-section is square.

6. A shipping container comprising a seamless paper tube having an exposed central portion with a circular cross-section and first and second ends, wherein at least one of the first and second ends has a non-circular, polygonal cross-section, wherein the polygonal cross-section has N sides, wherein N is an integer selected from 3 to 8, wherein a plurality of foldable flaps are provided at the end with the non-circular, polygonal cross-section, and wherein the end with the non-circular, polygonal cross-section is closable by folding the flaps inwardly and securing the flaps in place to form an integral end closure.

7. The shipping container according to claim 6, wherein at least two of said flaps are configured to overlap each other when folded inwardly.

8. The shipping container according to claim 6, wherein at least two of said flaps are configured to have abutting edges when folded inwardly.

9. The shipping container according to claim 6, wherein both ends of the tube are non-circular and polygonal in cross-section.

10. The shipping container according to claim 6, further comprising a non-roll extension configured to protrude from the end closure.

11. The shipping container according to claim 10, wherein the non-roll extension is a separate strip of material configured to be inserted into the end closure.

12. The shipping container according to claim 10, wherein the non-roll extension is a portion of a flap of material configured to be folded inwardly to form the end closure.

13. The shipping container according to claim 10, wherein the non-roll extension is flexible.

14. The shipping container according to claim 10, wherein an end of the non-roll extension is configured to be affixed to a side of the tube inward of the end closure.

15. The container according to claim 14, wherein the non-roll extension includes a fold and is triangular in cross-section when affixed to a side of the tube inward of the end closure.

16. A method comprising:

placing matter into a shipping container according to claim 6;

folding the flaps inwardly; and securing the flaps in place to form the end closure.

17. The method according to claim 16, wherein the flaps are secured in place using adhesive tape.

* * * * *